US007315140B2

(12) United States Patent
Sasaki et al.

(10) Patent No.: US 7,315,140 B2
(45) Date of Patent: Jan. 1, 2008

(54) CYCLOTRON WITH BEAM PHASE SELECTOR

(75) Inventors: Yuichiro Sasaki, Machida (JP); Kichiji Hatanaka, Ibaraki (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 11/050,817

(22) Filed: Jan. 27, 2005

(65) Prior Publication Data

US 2006/0164026 A1 Jul. 27, 2006

(51) Int. Cl.
*H05H 13/00* (2006.01)

(52) U.S. Cl. ..... 315/502; 315/507; 313/62; 250/423 R; 250/492.3

(58) Field of Classification Search ..... 315/500–507; 250/396 R, 423 R, 424, 492.3; 313/62
See application file for complete search history.

(56) References Cited

U.S. PATENT DOCUMENTS 2,625,653 A * 1/1953 Wouters ..... 324/76.83
2,778,937 A * 1/1957 Rossi ..... 315/502
3,227,957 A * 1/1966 Feldmann ..... 315/502
3,689,847 A * 9/1972 Verster ..... 315/502
3,935,503 A * 1/1976 Ress ..... 315/111.61
4,549,082 A * 10/1985 McMillan ..... 250/423 R
4,641,057 A * 2/1987 Blosser et al. ..... 313/62
4,789,839 A * 12/1988 Morris ..... 315/502
5,168,241 A * 12/1992 Hirota et al. ..... 315/500
5,739,646 A * 4/1998 Nakanishi et al. ..... 315/502
5,814,940 A * 9/1998 Fujisawa ..... 315/5.41
5,818,058 A * 10/1998 Nakanishi et al. ..... 250/492.3
6,441,569 B1 * 8/2002 Janzow ..... 315/502

(Continued)

FOREIGN PATENT DOCUMENTS

JP 2002-020321 1/2002

(Continued)

OTHER PUBLICATIONS

Kondo, M. "Recent Developments at the Osaka RCNP 230-CM Cyclotron and a Proposal for a New Ring Accelerator", *IEEE Trans on Nuclear Science*, NS-26, 2, pp. 1904-1911.

(Continued)

*Primary Examiner*—Douglas W. Owens
*Assistant Examiner*—Tung X Le
(74) *Attorney, Agent, or Firm*—McDermott Will & Emery LLP

(57) ABSTRACT

Disclosed here is a cyclotron having a beam phase selector capable of controlling phase widths of beams and improving beam permeability for increasing beam current. The cyclotron contains an acceleration voltage applying section and a beam blocking section, at least any one of the two sections has a movable structure. While a particle is passing across a gap between dee electrodes, the acceleration voltage applying section applies RF acceleration voltage to the particle, and further applies RF acceleration voltage having a phase different from the phase of previously applied RF acceleration voltage. The beam blocking section blocks undesired particles. Preferably, the acceleration voltage applying section at least has an electrode having an opening in a direction of the core of the cyclotron. Also preferably, operations on phase-width control can be performed outside the cyclotron, with vacuum condition in the cyclotron maintained.

10 Claims, 14 Drawing Sheets

U.S. PATENT DOCUMENTS

| | | | | |
|---|---|---|---|---|
| 6,603,247 | B1 * | 8/2003 | Seward | 313/231.31 |
| 6,683,426 | B1 * | 1/2004 | Kleeven | 315/502 |
| 7,038,403 | B2 * | 5/2006 | Mastrangeli et al. | 315/502 |
| 2003/0197121 | A1 * | 10/2003 | Turecek et al. | 250/281 |
| 2005/0247890 | A1 * | 11/2005 | Norimine et al. | 250/492.3 |
| 2005/0263695 | A1 * | 12/2005 | Syka | 250/291 |
| 2007/0001128 | A1 * | 1/2007 | Sliski et al. | 250/492.3 |

FOREIGN PATENT DOCUMENTS

| | | |
|---|---|---|
| JP | 2002-025797 | 1/2002 |

OTHER PUBLICATIONS

"Recent Developments of the Ring Cyclotron", *Nucleus Research* vol. 36, No. 2, pp. 3-15, 1991 and in Miura, I., "The Research Center for Nuclear Physics Ring Cyclotron", *Proceedings of the 1993 Particle Accelerator Conference* vol. 3 of 5, pp. 1650-1654.

Itahashi, T., et al., "Operation of RCNP AVF Clyclotron", *RGNP Annual Report* 1991, pp. 207-210.

Sasaki, Y., et al., "A New Beam Phase Selector for the AVF Cyclotron", *RCNP Annual Report* 1996, pp. 178-181.

* cited by examiner

CYCLOTRON WITH BEAM PHASE SELECTOR

FIELD OF THE INVENTION

The present invention relates to a cyclotron having a beam phase selector for effectively controlling phase widths of beams.

BACKGROUND ART

FIG. 11 shows how particles are accelerated in a cyclotron. A cyclotron is typically formed of an electromagnet and dee electrodes 1. The whole structure of dee electrode 1 is accommodated in an evacuated box. Accelerated particles including protons are generated in an ion source located at cyclotron core 3. The ion source located in an evacuated box is often called an internal ion source. On the other hand, there is another type of cyclotron, where the ion source is disposed outside the cyclotron and beams are conveyed from the ion source to cyclotron core 3. The structure has an advantage of being accessible to the ion source in maintenance work, with the vacuum condition of the evacuated box maintained. Such an ion source disposed outside the evacuated box is called an external ion source. In a cyclotron having an external ion source, beams conveyed from the external ion source are fed into cyclotron core 3 and then accelerated.

In FIG. 11, RF acceleration voltage is applied to dee electrodes 1. Each time passing across gap 2 disposed between dee electrodes 1, a particle gains energy corresponding to the electric field between dee electrodes 1. Because the electric field does not penetrate deep into dee electrodes 1, the particle traveling through the electrodes has no influence of the electric field. When reaching gap 2 after semicircle traveling, the particle receives a 180° phase-shifted RF acceleration voltage, so that the particle gains energy from the electric field. In this way, starting from cyclotron core 3, the particle gains energy from the electric field each time it reaches gap 2 after a semicircle travel, and accordingly, the orbital radius of the traveling particle is getting larger. At a position close to the circumference of the magnetic pole, deflector 4, which is a high voltage electrode for capturing beams, is disposed. The particle entered into deflector 4 is retrieved, by radially-outward force, from the magnetic field of the cyclotron. Generally, a particle is supposed to be accelerated 1000 times during the 500 times go-around. Particles having difference in phase with respect to the RF acceleration voltage at the start from cyclotron core 3 are to be given different acceleration voltage, which invites variations in energy to be gained by particles and variations in orbits of the particles. The variations in orbits lower the efficiency of retrieving beams, and the variations in energy degrade the quality of retrieved beam 5. To avoid the inconveniencies above, an improved cyclotron capable of keeping the phase width of a beam small at the first-turn of the acceleration process has been needed for providing beams with high quality.

Responding to the demand, various methods of minimizing the variations in phase widths of beams have been introduced. For example, a cyclotron having a phase slit is disclosed in one suggestion (see Recent Developments at the Osaka RCNP 230-cm Cyclotron and a Proposal for a New Ring Accelerator, IEEE Trans NS-26, 2, pp. 1904-1911). According to the method, after leaving the internal ion source and passing across gap 2 twice, the particles undergo screening by the phase slit-undesired particles are blocked and not allowed to pass through. The phase slit has a beam blocking section movable disposed in a radial direction from cyclotron core 3 with respect to the orbit of the particle centered in a beam.

Explanations hereinafter will be given with reference to FIGS. 12 and 13. FIG. 12 illustrates RF acceleration voltage to be applied at gap 2 to a beam having a time lag equivalent to ±40° of the phase of the voltage. The description will be given on acceleration of a particle bearing positive charge. The application of voltage is usually controlled so that RF acceleration voltage with a phase of 270° is applied to the particle traveling in the middle of the time lag when the mid particle passes across gap 2. That is, the mid particle gains energy at point A3 in FIG. 12. Particles traveling 40° behind, and 20° behind in phase with respect to the mid particle gain energy for acceleration at point A1 and A2, respectively. On the other hand, particles traveling 40° ahead, and 20° ahead in phase gain energy at point A5 and A4, respectively. The orbit taken by a particle depends on the amount of energy gained by the particle. The orbit of a particle at the first turn is easily explained.

FIG. 13 illustrates the orbit of an accelerated particle at the first turn in a cyclotron. Each particle gains energy with the application of acceleration voltage at point An (in FIG. 12), and takes the orbit n (where, n takes 1 to 5). The mid particle gains energy at the highest acceleration voltage, and therefore the particle takes the orbit having the largest orbital radius; the mid particle takes the outermost orbit 3. On the other hand, a phase-shifted particle gains energy smaller than the mid particle; accordingly, the orbital radius of the particle is smaller than that of the mid particle. Each particle accelerated at A2 and A4 takes the same orbit, i.e., orbit 2 (4), and similarly, each particle accelerated at A1 and A5 takes the same orbit, i.e., orbit 1 (5). Many of conventional phase control structure, such as phase slit 6 in FIG. 13, have used the difference in orbits described above. That is, a conventional cyclotron often contains a beam blocking section disposed movable in the radially-outward direction from cyclotron core 3.

FIG. 13 shows oval-shaped blocking section 7 as an example. Rotating oval blocking section 7 can change beam control. For example, when blocking section 7 is disposed at the position as shown in FIG. 13, the particles traveling along orbit 1 (5) are blocked, whereas the particles taking orbit 3 and orbit 2 (4) continue to travel, so that the phase widths of the beam are limited within ±20°. In addition to blocking section 7, disposing conventional phase slit 14 can also block undesired particles taking orbits in a direction of radially-outside from the mid orbit. When a cyclotron employs an internal ion source, phase widths of beams can be limited within a desired range, whereby beams with consistent energy can be obtained.

However, the aforementioned phase slit produces an inconvenience in a cyclotron employing an external ion source; disposing conventional phase slits, such as phase slits 6 and 14, lowers beam permeability to approx. 1/50, and therefore weakens beam current. The problem probably comes from the difference in incidence energy of particles to be fed into the cyclotron. In a cyclotron having an internal ion source, particles are drawn out from the ion source by RF acceleration voltage applied to gap 2—the incident energy of a particle is nearly zero. In contrast, in a cyclotron having an external ion source, particles are drawn out from the ion source by voltage applied to an interconnect electrode of the ion source—a particle already has an energy before being fed into the cyclotron. Generally, having 10 keV or more energy, protons are fed into a cyclotron via an axial incidence system. Due to the incident energy, the difference in energy among the particles relative to an absolute value of energy becomes small. Accordingly, the difference in orbits taken by the particles becomes narrow. Therefore, the conventional beam control method—where the control of phase widths is relied on the difference in orbits caused by the difference in energy gained by a particle at the gap—is not effective in blocking out undesired particles.

To address the problem above, suggestions on a phase slit in a cyclotron employing an external ion source are introduced, for example, in *Recent Developments of Ring Cyclotron, Nucleus Research* Vol. 36, No. 2, pp. 3-15, 1991, and in *The Research Center for Nuclear Physics Ring Cyclotron, Proceedings of the* 1993 *Particle Accelerator Conference* Volume 3 of 5, pp. 1650-1654.

FIG. 14 shows conventional phase slit 8 introduced in a suggestion above. Conventional phase slit 8 has electrode 9 and electrode 10. Electrode 9 has an opening in a direction of a core of a cyclotron, and electrode 10 is disposed in a radially outside position of the cyclotron so as to face electrode 9.

While the particles are traveling through dee electrode 1 after first passing of gap 2 since the start at cyclotron core 3, the particles reach dee electrode 1, and undesired particles of them are blocked by electrodes 9 and 10. Usually, the particles have no effect from electric field. However, through the opening of electrode 9, electric field leaks into dee electrode 1, so that the particles gain energy from the leakage electric field that is on its way changing from minus to plus of RF acceleration voltage. The leakage electric field affects on the beam with a time lag so as to replace distribution of time with distribution of orbital radius. As a result, at the exit of the phase slit, the beam has a stretch in a radial direction of the cyclotron.

FIG. 14 shows the orbits ±15°-shifted in phase from the orbit of the mid particle. The phase-shifted particles are blocked by electrode 9 with an opening and electrode 10 disposed in a radially-outward position of the cyclotron so as to be opposite to electrode 9. The structure of FIG. 14 can block out particles phase-shifted ±15° or more. The particles with a phase shift of ±15° were assumed to take inward and outward orbits, being equally away from the orbit of the mid particle. Considering this, the two electrodes were properly shaped and fixed so as to contact with the orbits having a phase shift of ±15° from the orbit of the mid particle. An experiment was done by using conventional phase slit 8 and the result is disclosed in *Operation of RCNPAVF Cyclotron, RGNP Annual Report* 1991, pp. 207-210. According to the report, the beam permeability when a cyclotron employs an external ion source is improved to 1/5-1/7.

Generally, a phase-width control that can provide a larger beam current for a consistent phase width is more preferable. Therefore, the phase width control method capable of providing a consistent phase width and increased beam current has been demanded. An effort to address the problem is introduced in *A NEW BEAM PHASE SELECTOR FOR THE AVF CYCLOTRON, RCNP Annual Report* 1996, pp. 178-181. In the report, the orbit of a particle is calculated by a calculator through three-dimension field analysis of the core area of a cyclotron. According to the result of the orbit calculation, beam permeability measured 1/16-1/30, having no direct contribution to improvement in efficiency of performance.

The needs for an improved method and device of selecting phase width—not only obtaining a consistent phase width but also providing improved beam permeability for larger beam current—have been raised.

SUMMARY OF THE INVENTION

The cyclotron of the present invention at least contains an acceleration voltage applying section for applying an RF acceleration voltage to a particle when the particle passes a gap between the dee electrodes, and for further applying an RF acceleration voltage with a phase different from the previously applied RF acceleration voltage; and a beam blocking section for blocking out undesired particles. At least any one of the acceleration voltage applying section and the beam blocking section is movably disposed in a cyclotron.

DETAILED DESCRIPTION OF THE INVENTION

Exemplary Embodiment

Hereinafter will be described how the acceleration voltage applying section of the present invention works in accordance with the principle of operation.

Figure 1:
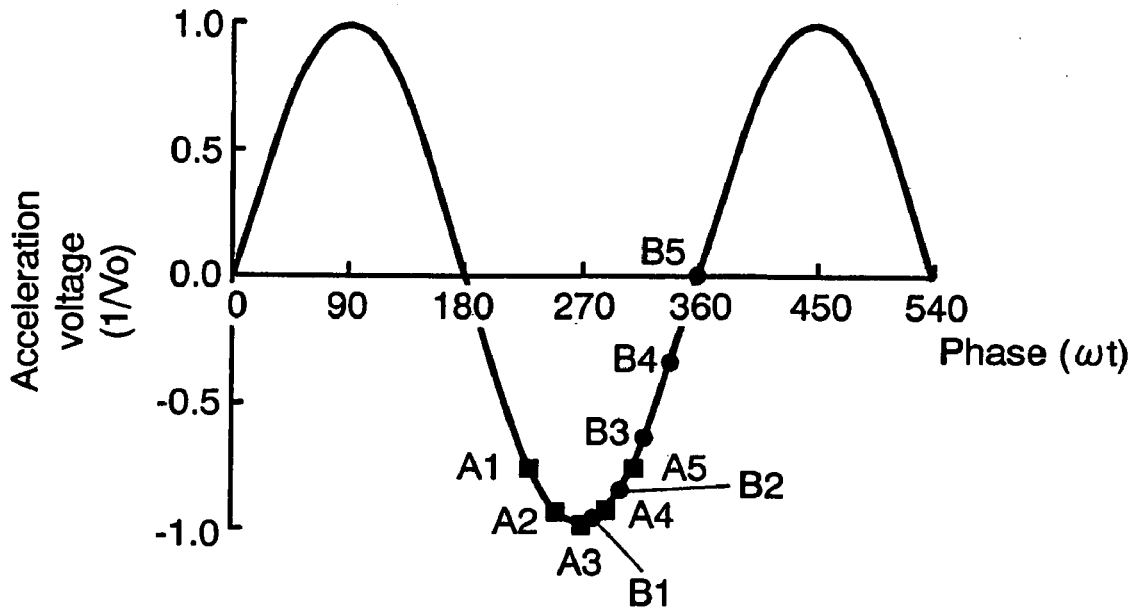
FIG. 1 shows RF acceleration voltage applied to a beam with a time lag at an acceleration voltage applying section of the present invention.
Figure 12:
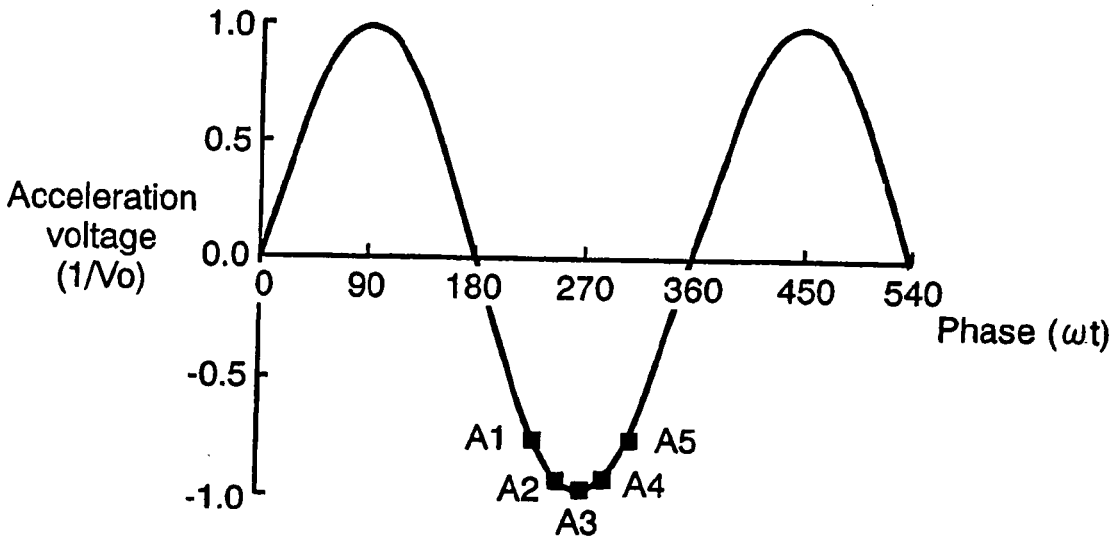
FIG. 12 (PRIOR ART)
FIG. 12 illustrates RF acceleration voltage applied to a beam having a time lag at a gap.

FIG. 1 shows an RF acceleration voltage applied to a beam with a time lag at an acceleration voltage applying section of the present invention. When particles pass across gap 2, acceleration voltage is applied to the particles at positions A1 through A5. This is the same as that of the conventional example (FIG. 12) described earlier in Background Art. In addition to the application of the voltage, the acceleration voltage applying section of the present invention further applies an RF acceleration voltage having a phase different from those applied at positions A1 through A5. For example, position Bn of FIG. 1 has a phase shift of 50° from position An.

Figure 2:
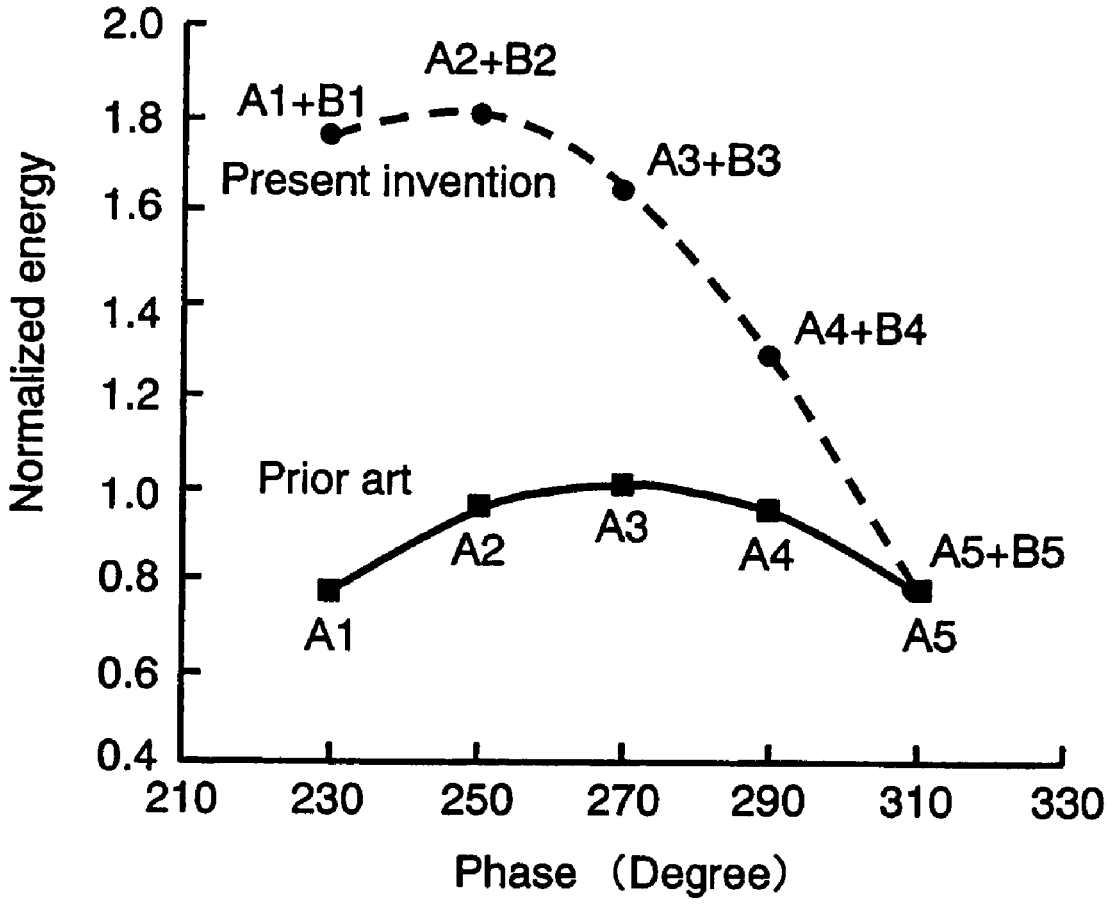
FIG. 2 shows energy gained by particles having different phases.
Figure 11:
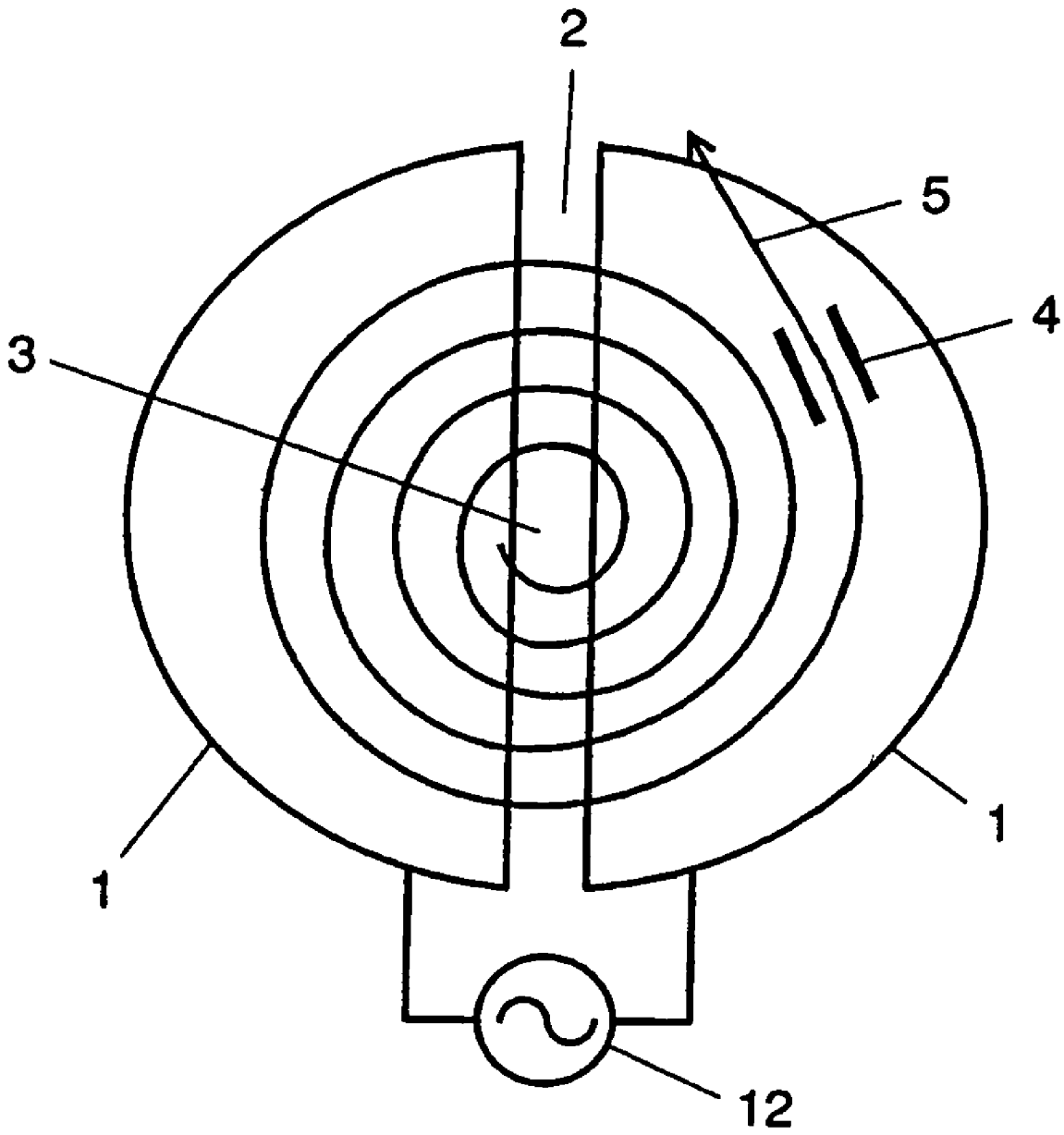
FIG. 11 (PRIOR ART)
FIG. 11 shows how a particle is accelerated in a cyclotron.

FIG. 2 shows total energy gained by each particle accelerated at points A1 through A5. According to the present invention, each particle is accelerated at points An and Bn, and the energy gained by the particle is a total of the energy gained at An and Bn. The vertical axis of the graph of FIG. 2 represents total energy gained by each particle, showing as normalized values with respect to the energy gained by the conventional mid particle. The horizontal axis represents phases of the RF accelerate voltage applied to each particle when the particle passes gap 2 (see FIG. 11 and FIG. 14)

According to the present invention, the particle, which is accelerated and gained energy at point A1, further gains energy at point B1. In total, the energy gained by the particle is nearly 1.75 times as high as that gained by the mid particle in the prior-art; accordingly, the orbital radius of the particle becomes larger. On the other hand, the particle accelerated at point A5 is supposed to gain energy at point B5. However, the acceleration voltage to be applied to the particle is nearly zero at point B5, as shown in FIG. 1. That is, the particle gains no additional energy at B5. The energy gained by the particle accelerated at points A5 and B5 is about 0.75 times the energy gained by the mid particle. As is apparent from the graph of FIG. 2, the difference in energy gained by particles having different phase becomes larger than that observed in the conventional example. The fact advantageously works in converting the difference in phases into difference in orbits, even if a particle started from an external ion source has already gained incident energy.

Figure 3:
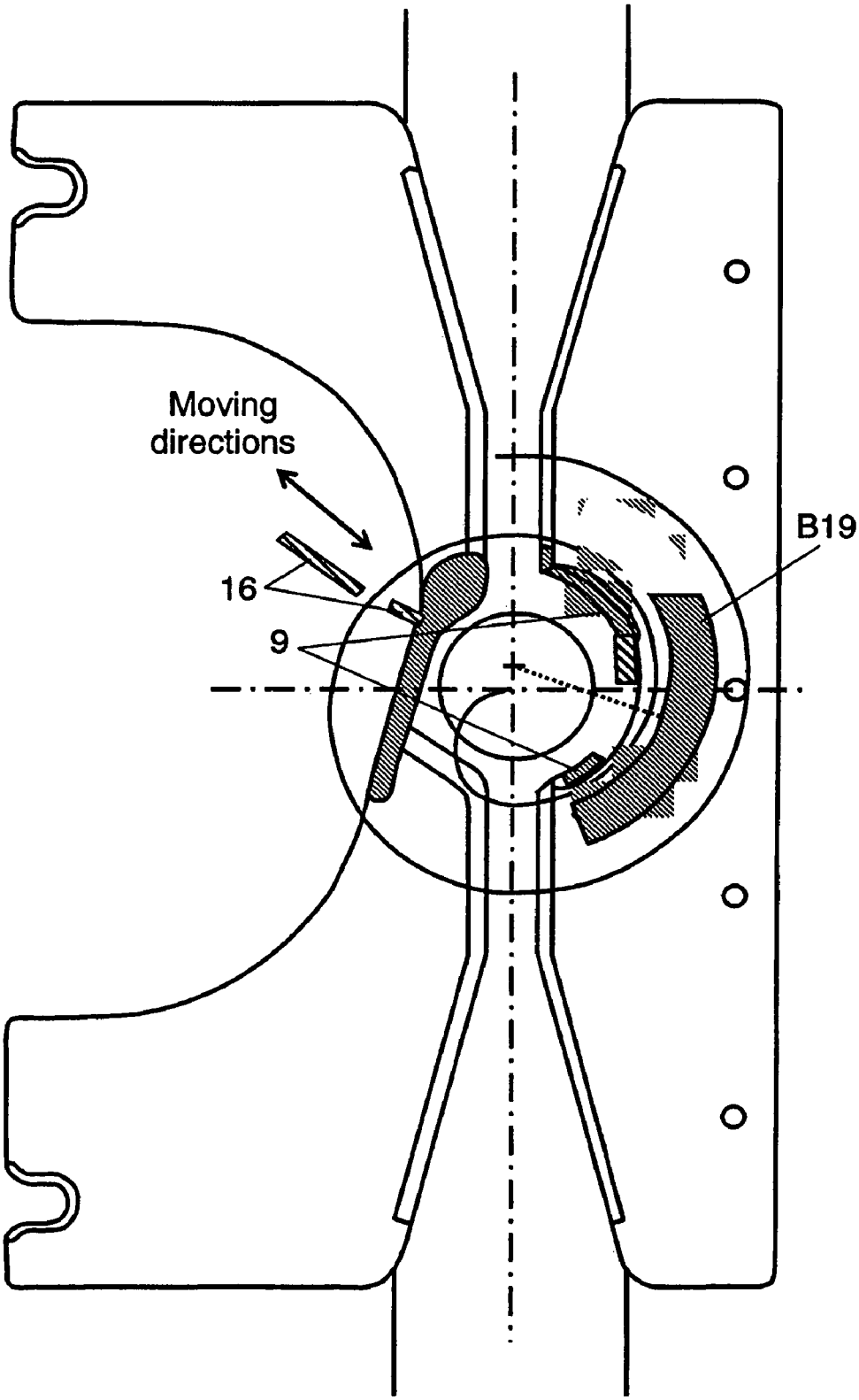
FIG. 3 is a section view illustrating the essential part of phase slit 17 of the present invention.

The acceleration voltage applying section of the present invention can be structured as an improvement of conventional phase slit 8; dee electrode 1 contains i) electrode 9 having an opening in a direction of the center of the cyclotron of FIG. 3 and ii) movable electrode B19 disposed in a radially-outward position.

Figure 4:
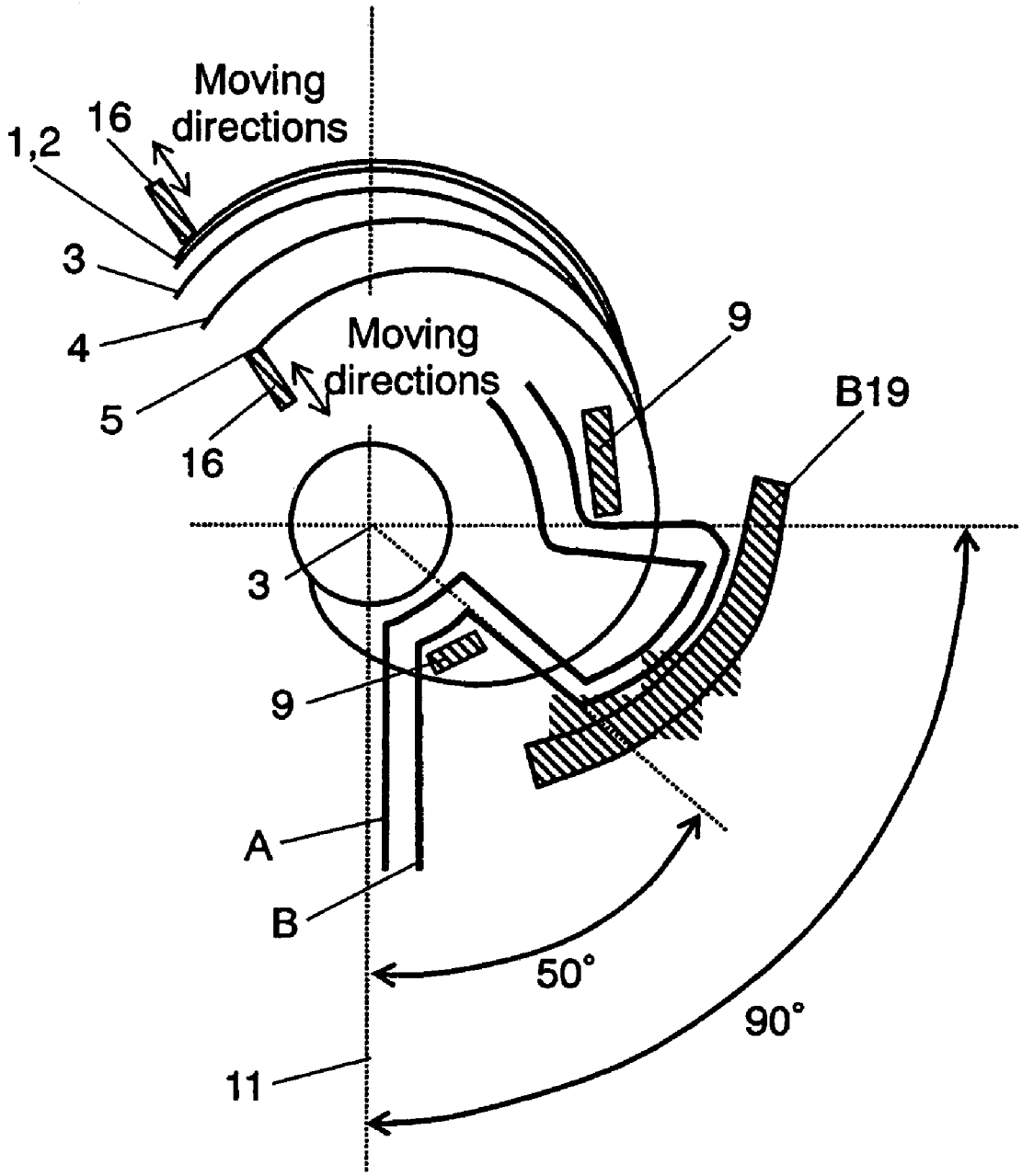
FIG. 4 is a detail view of phase slit 17 of FIG. 3.

Now will be given in-detail explanation on the phase slit of the present invention with reference to FIG. 4. Electric field for acceleration leaks into dee electrode 1 through the opening of electrode 9. The phase slit is structured on consideration that the electric field has a distribution within a range at an angle of 50°-90° with centerline 11 of gap 2. Particles are accelerated between the equipotential lines A and B. When passing centerline 11, the mid particle in the range of a time lag experiences RF acceleration voltage with a phase of 270° and travels the orbit. When the mid particle reaches the position being on a 50° angle with centerline 11, 320°-phased RF acceleration voltage is applied to the particle. Further, when passing the position being on a 90° with centerline 11, the particle experiences an application of 360°-phased RF acceleration voltage. After that, the particle gains energy only when passing across gap 2 as is general acceleration. The influence of electric field on a particle is limited between equipotential lines A and B.

The amplitude of the acceleration voltage applied to a particle when the particle passes the position being on a 90° with centerline 11 is nearly zero—the particle gains no energy. That is, the orbit of a particle depends on the energy gained when the particle passes gap 2 and the position being on a 50° with centerline 11 of the gap. With the structure above, the acceleration voltage applying section of the present invention effectively functions in an intended manner. Although the conventional two electrodes are fixed at a proper position from the design point of view, the two electrodes in the structure of the present invention should preferably be movable. Because that the electrodes with movable structure can keep an optimal position according to different types of particles and different acceleration voltage. It is also because that difference in fine adjustment of an ion source or a beam-conveying system can affect on the optimal position at which the electrodes should be placed.

Besides, changing the position of the electrodes can control distribution of the equipotential lines; although electric field has a leakage range of 50°-90° in the description above, the range can be flexibly set according to the distribution of the equipotential lines.

Figure 14:
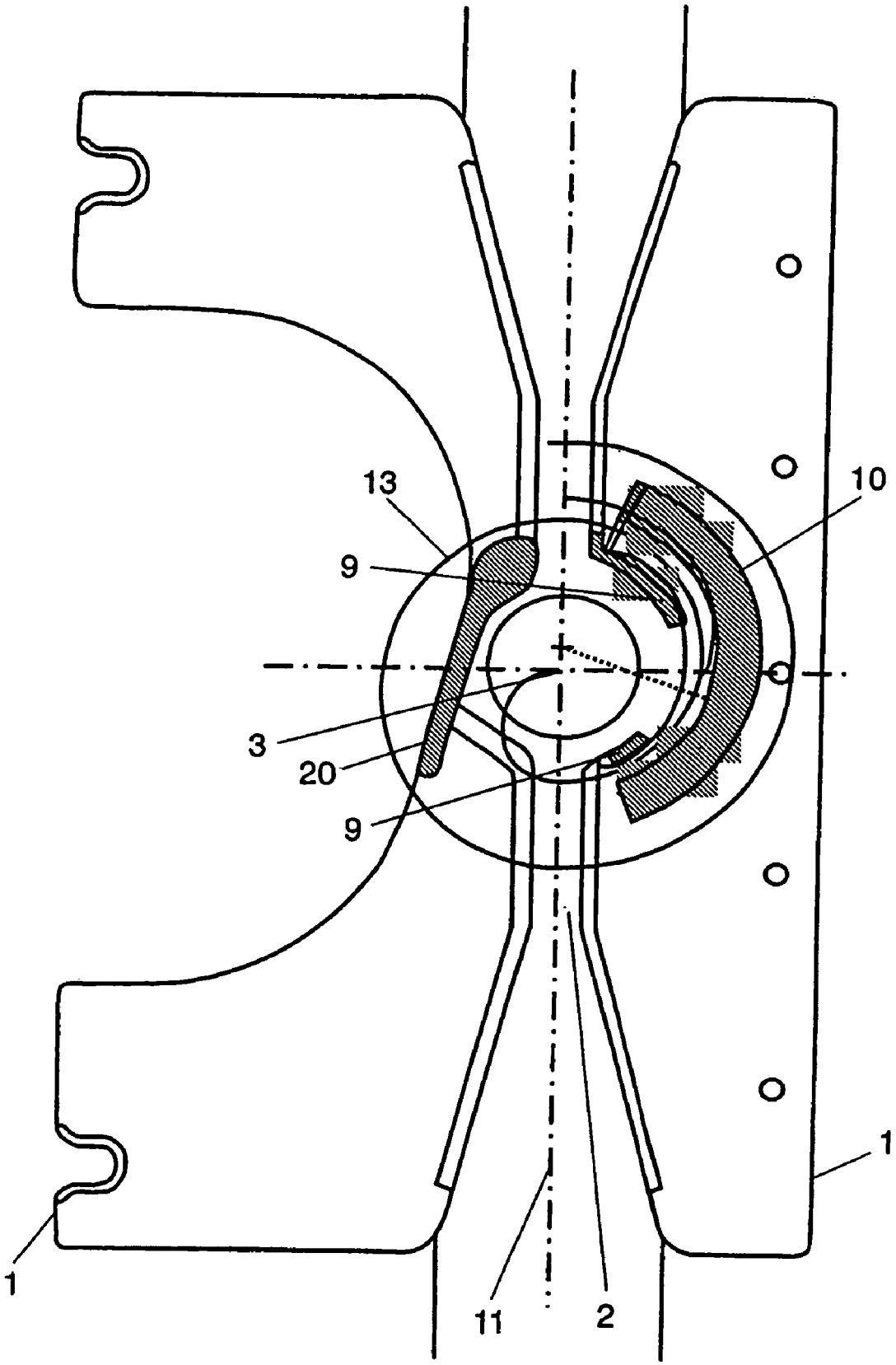
FIG. 14 (PRIOR ART)
FIG. 14 is a section view illustrating the essential part of conventional phase slit 8.

In the structure of the present invention, preferably, the acceleration voltage applying section and the beam blocking section should separately function. To be more specific, separating the orbits by phase of the particles in the acceleration voltage applying section, and then selecting appropriate particles by blocking out of undesired particles in the beam blocking section. By virtue of separating each function, the acceleration voltage applying section and the beam blocking section can be disposed at each effective position. Such an acceleration voltage applying section is structured like electrode B19 (FIG. 3) as an improvement over the conventional phase slit (FIG. 14). The improved structure is movably disposed in a radially-outward position so as to avoid the collision of particles at around the end of the slit.

The explanation will turns to the beam blocking section. Orbit n (n takes 1 through 5) in FIG. 4 corresponds to the orbit of the particle accelerated at points An and Bn. Orbit 1 and orbit 5 shown in FIG. 4 tell that each particle accelerated at point A1 and point A5—which had the same orbit in the prior-art—now takes different orbit in the structure of the present invention. Besides, the mid particle traveled the outermost orbit in the conventional structure, whereas, in the structure of the present invention, the orbits of the particles phase-shifted from the mid particle spread out in a radial direction of a cyclotron, with the orbit of the mid particle centered. Therefore, disposing beam blocking sections 16—which are inwardly and outwardly movable in a radial direction of a cyclotron—can limit the phase widths into a desired range. Conventional phase slits 6 and 14 may be employed for the beam blocking section of the present invention. The orbits of the phase-shifted particles are not always distributed, at equally spaced intervals from the orbit of the mid particle, in the radially-inward/outward directions. The distribution of the orbits is also susceptible to various conditions: ion seeds of particles; acceleration energy; RF acceleration voltage; the frequency of RF acceleration voltage; magnetic field; incident energy; ambient temperature; and the temperature of water used for cooling an electromagnet. In the practical use, however, it will be impossible to maintain all the conditions above constant, and furthermore, the distribution of the orbits can vary according to experimental conditions, a season in a year, and a time period in a day. Therefore, the structure, in which at least any one of the acceleration voltage applying section and the beam blocking section is movable in operation, is effective in coping with the changes.

In this way, the method and device of selecting phase width of the present invention can select desired phase widths of beams and increase beam permeability to obtain larger beam current.

Hereinafter, the present invention will be described in detail in an embodiment.

The result obtained from the orbit calculation introduced earlier in Background Art has little contribution direct to performance improvements; the calculation, however, revealed a tendency of orbit distribution in a cyclotron. With reference to the result of the orbit calculation, the phase slit of the embodiment was formed.

Figure 5:
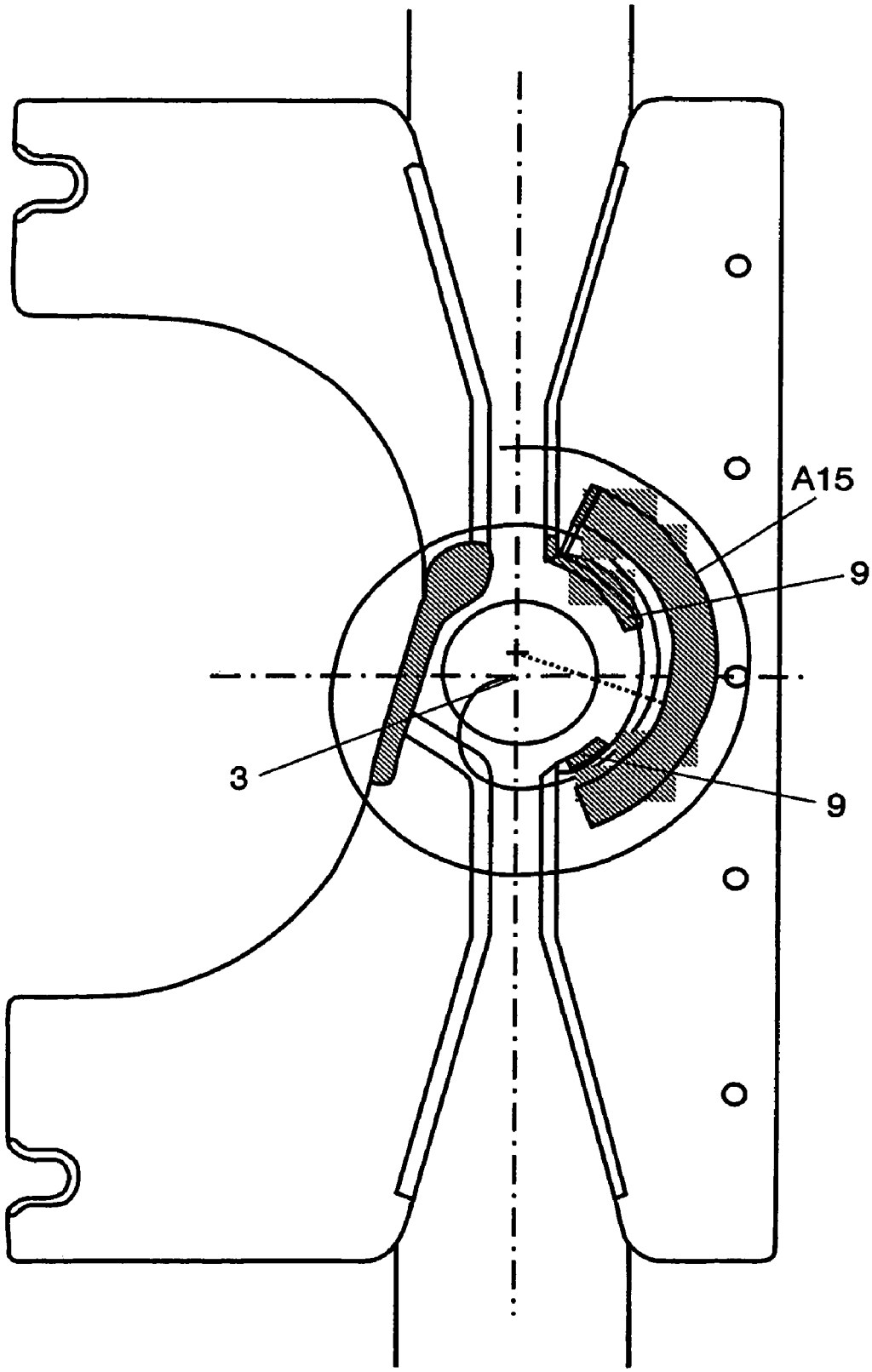
FIG. 5 is a section view illustrating the essential part of phase slit 18 of the present invention.
Figure 13:
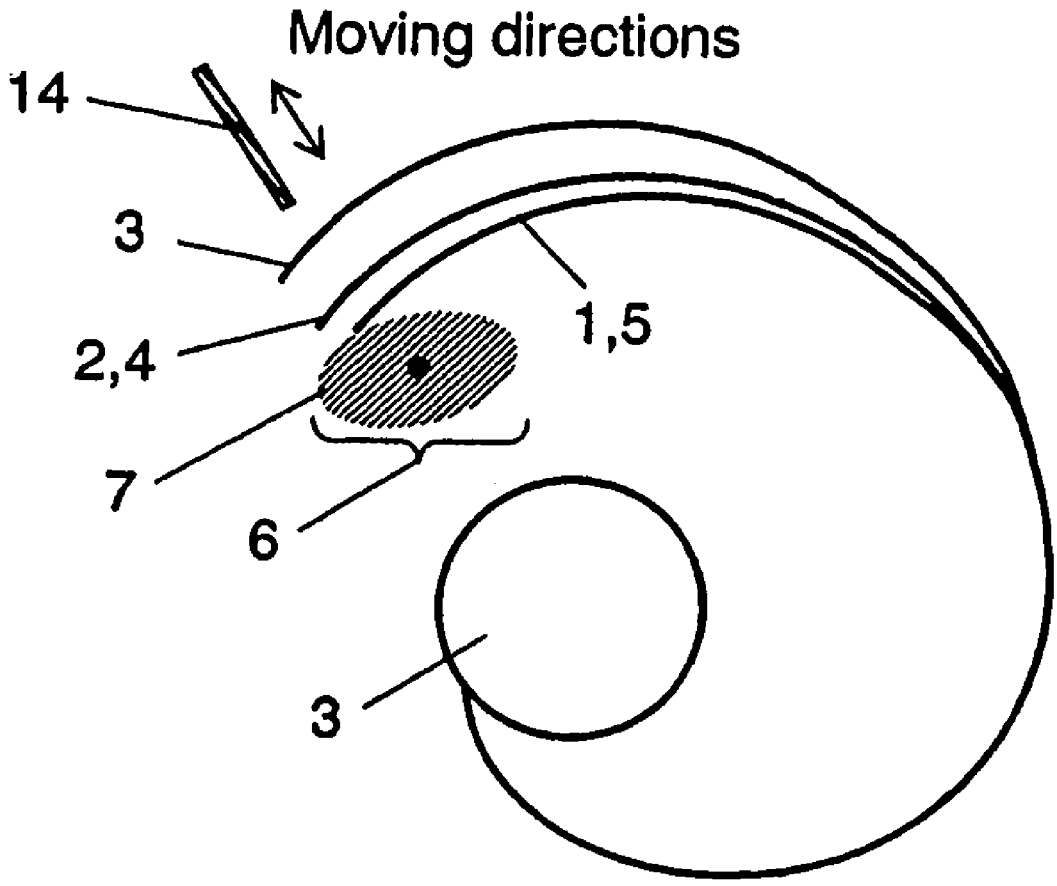
FIG. 13 (PRIOR ART)
FIG. 13 illustrates the first-turn of the orbit of a particle when the particle is accelerated in a cyclotron.

FIG. 5 illustrates phase slit 18 introduced in the embodiment of the present invention. The acceleration voltage applying section of the structure is the improvement of the conventional structure in FIG. 14. Phase slit 18 has electrode 9 having an opening in a direction of the core of the cyclotron, and movable electrode A15 disposed in a radially-outward position. To make electrode A15 "movable", conventional electrode 10 disposed in a radially-outward position is mounted on a pedestal and connected to a driving device. Moving operation of electrode A15 can be performed outside the cyclotron, with the vacuum condition of the cyclotron maintained. Electrode A15 can be vertically, horizontally, and rotationally moved. Movable electrode A15 disposed in a radially-outward position doubles as the beam blocking section. With the structure, some of the particles go into electrode 9 and movable electrode A15, whereby the particles are blocked out. A percentage of blocked-out particles can be controlled by moving the position of electrode A15. To retrieve protons with energy of 64-65 MeV, protons were accelerated in an AVF cyclotron having phase slit 18 of the present invention. The protons were generated in an external ion source and conveyed through an axial incident system to feed into cyclotron core 3 with an incident energy of 15 keV. In the process of accelerating particles, a buncher is typically used prior to the incidence; the embodiment, however, did not employ the buncher for the purpose of examining for the functions of the phase slit. The beam current value was measured at the inlet and the outlet of the cyclotron. The beam permeability was calculated from the inlet/outlet values of the beam current. The pulse width of beam 5 fed from the cyclotron was measured. The phase width was converted from the pulse width. The measurement of the beam current value and the pulse width was carried out for different positions of movable electrode A15 disposed in a radially-outward position. To compare to the structure of the present invention, aforementioned measurements were similarly made by not only conventional fixed-type phase slit 8 but also phase slits 6 and 14 of FIG. 13. The result of the measurements by phase slits 6 and 14 will be shown in the description below.

Figure 6:
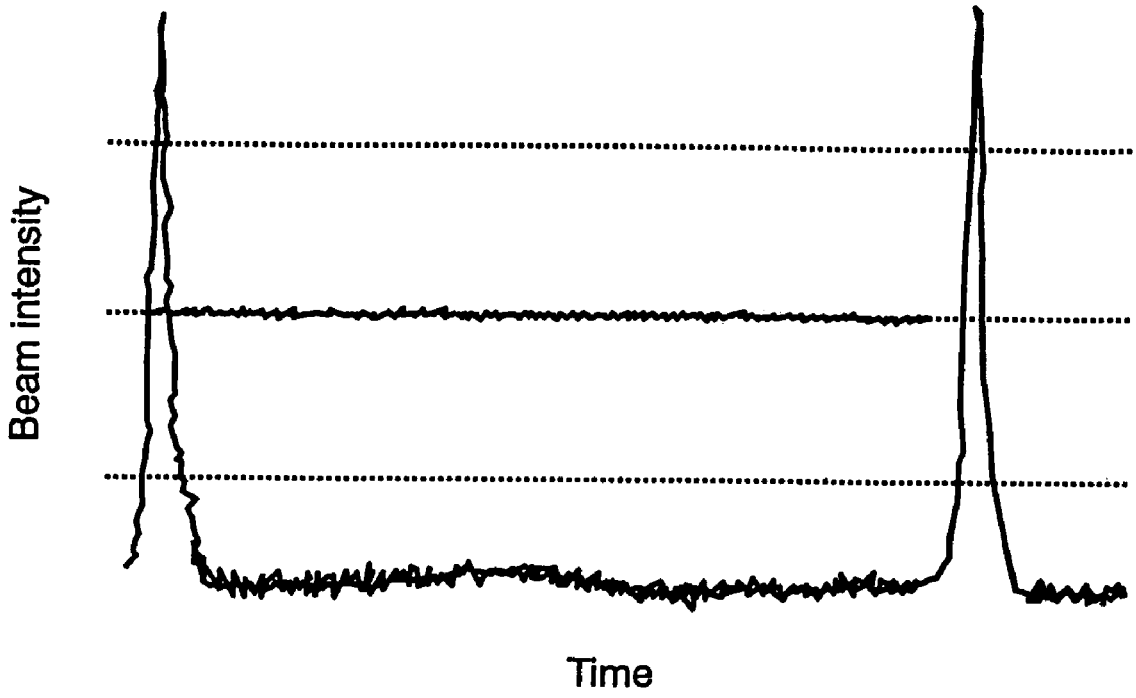
FIG. 6 shows time distribution of intensity of a beam observed through the use of phase slit 18 of the present invention.
Figure 7:
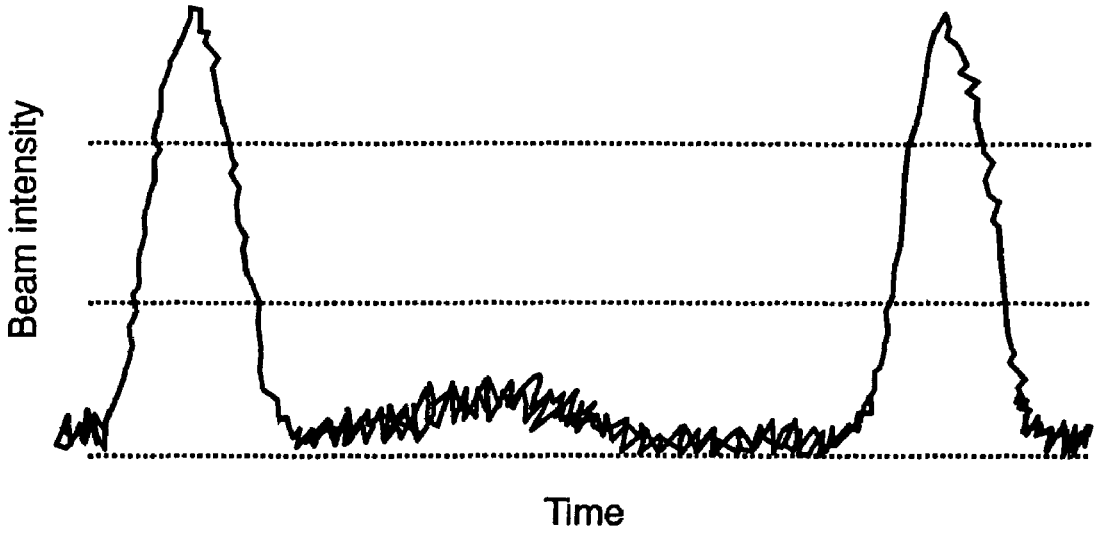
FIG. 7 shows time distribution of intensity of a beam observed without the use of a phase slit.
Figure 8:
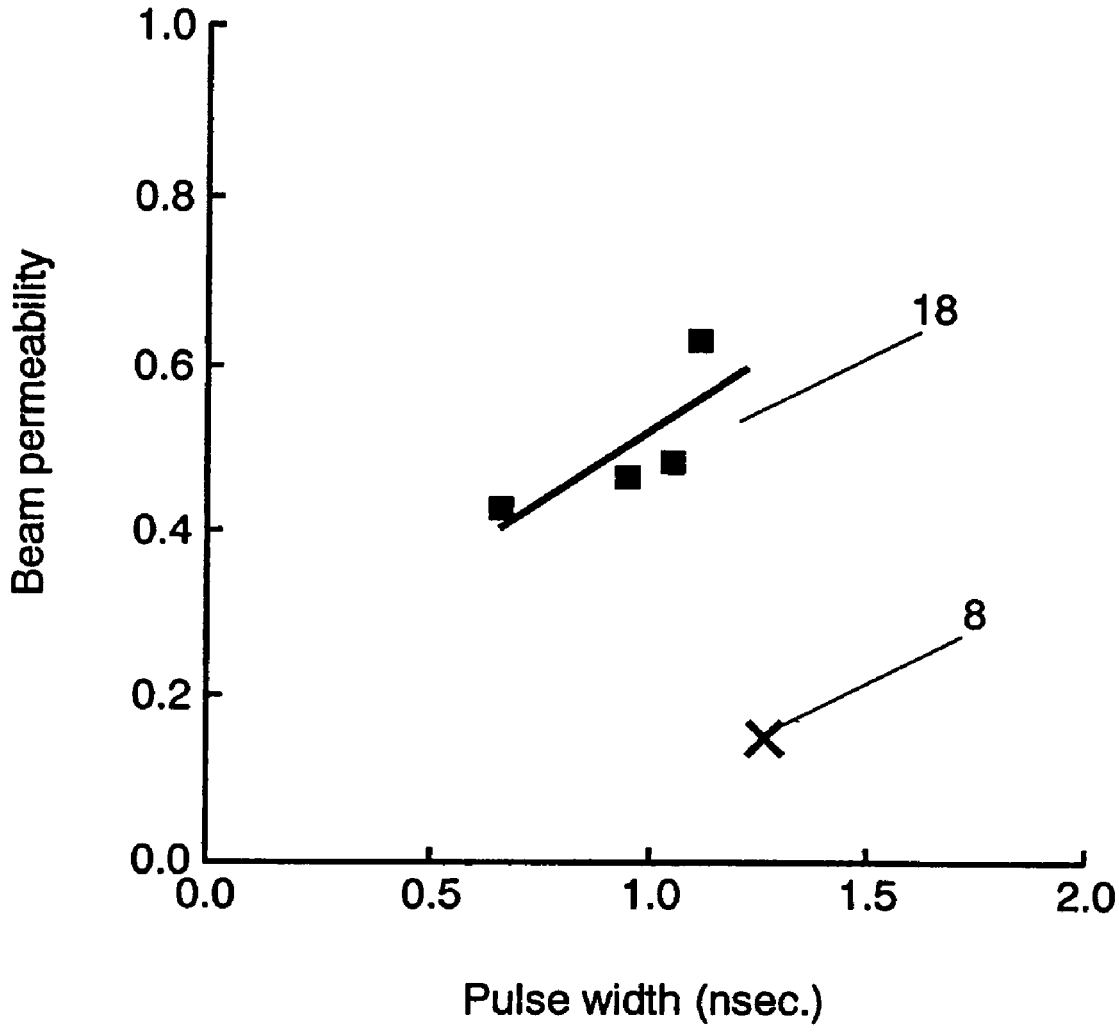
FIG. 8 shows the relation between pulse widths and beam permeability.

FIG. 6 shows time distribution of intensity of beam 5 fed out of a cyclotron when phase slit 18 of the present invention is used. The horizontal axis represents time, and the vertical axis represents a beam current value. The full width at half maximum measured 1.48 nsec. This value is converted to a phase width of 9.0°. On the other hand, FIG. 7 shows time distribution of intensity of a beam without the use of a phase slit. The full width at half maximum measured 9.13 nsec, which is converted to a phase width of 55.5°. As is apparent from the measurements above, phase slit 18 of the present invention reduces the phase width of the beam from 55.5° to 9.0°. The measurements shown in FIG. 6 and FIG. 7 were made like this: radiating the beam onto a prove to generate X-rays; measuring the X-rays by a scintillation counter; and then differentiating the result with respect to time. Although both the vertical axes of FIGS. 6 and 7 represent a beam current value, the values of the vertical axes of the two graph cannot be directly compared with each other because the differentiate time are different between for the two measurements. FIG. 8 shows the relation between pulse widths and beam permeability. Prior to the measurements, the inventor carried out a predetermined alignment to electrode A15 with respect to its movement in vertical, horizontal, and rotational direction as shown in FIG. 15, while observing the beam current value of beam 5 obtained from the cyclotron. Electrode A15 is, as described above, movably disposed in a radially-outward position. After the alignment, the pulse width and the beam current value were measured at predetermined positions in the horizontal movement of electrode A15. A pulse width of a beam means the full width at half maximum of the beam measured above. With phase slit 18 of the present invention, the pulse width can be selectively changed in the range of 0.67 to 1.12 nsec. This equates to the phase width ranging from 4.1° to 6.8°. The beam permeability was changed approx. from 0.4 to 0.6. On the other hand, in the use of conventional phase slit 8, the pulse width measured 1.27 nsec. The value equates to 7.7° in phase width. The beam permeability measured 0.15. The result of the measurements proves that phase slit 18 of the present invention can narrowly limit the phase widths by properly moving the position of electrode A15 according to experimental conditions, thereby improving the beam permeability ranging 0.4 to 0.6. Furthermore, compared to the conventional structure, a desired pulse width and beam permeability, i.e., a desired beam current value can be selected by controlling the position of the electrode. In the measurement with the use of conventional phase slits 6 and 14 (FIG. 13), the beam permeability measured 0.02, which shows extremely low beam current value.

Figure 9:
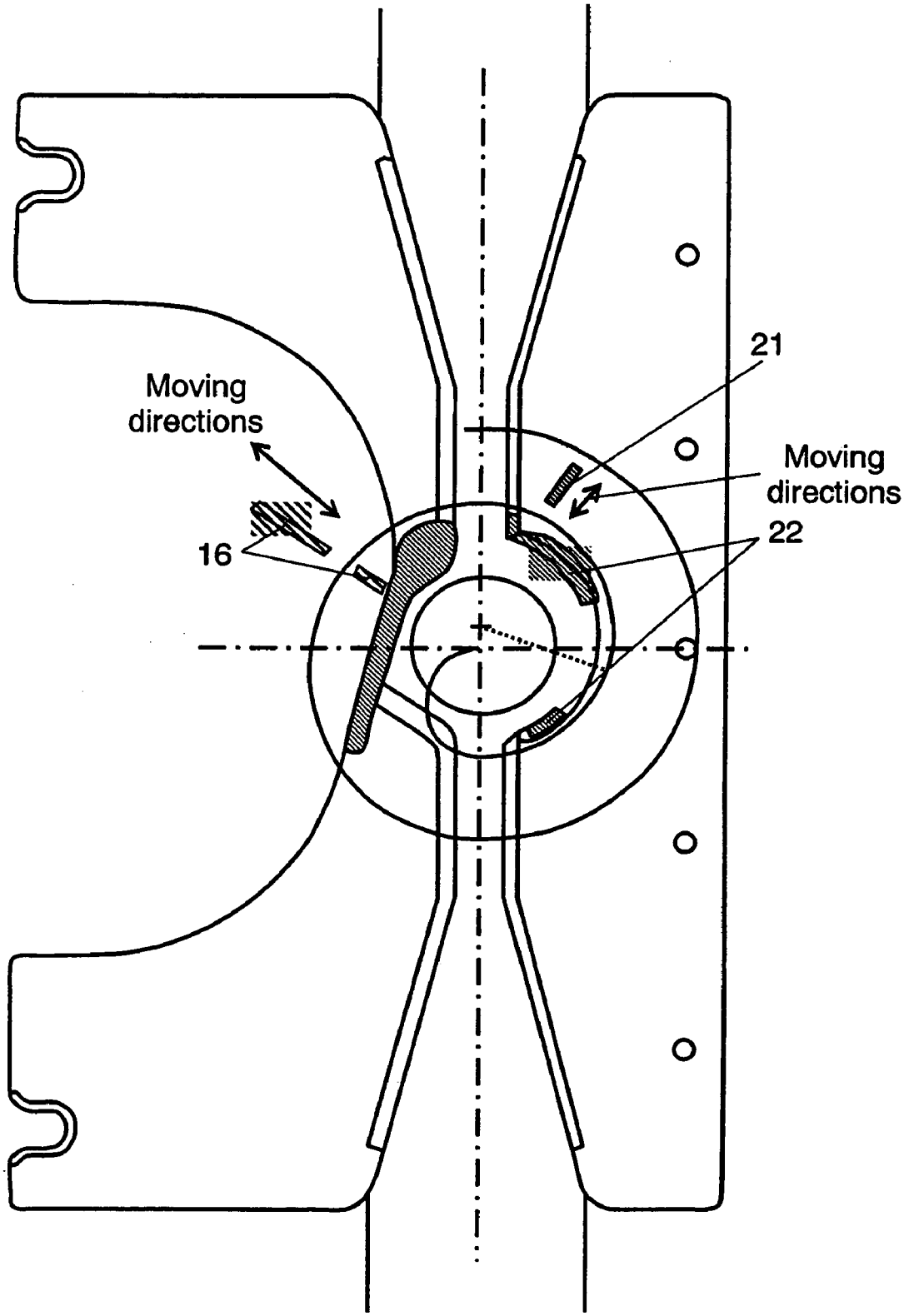
FIG. 9 shows another phase slit of the present invention.
Figure 10:
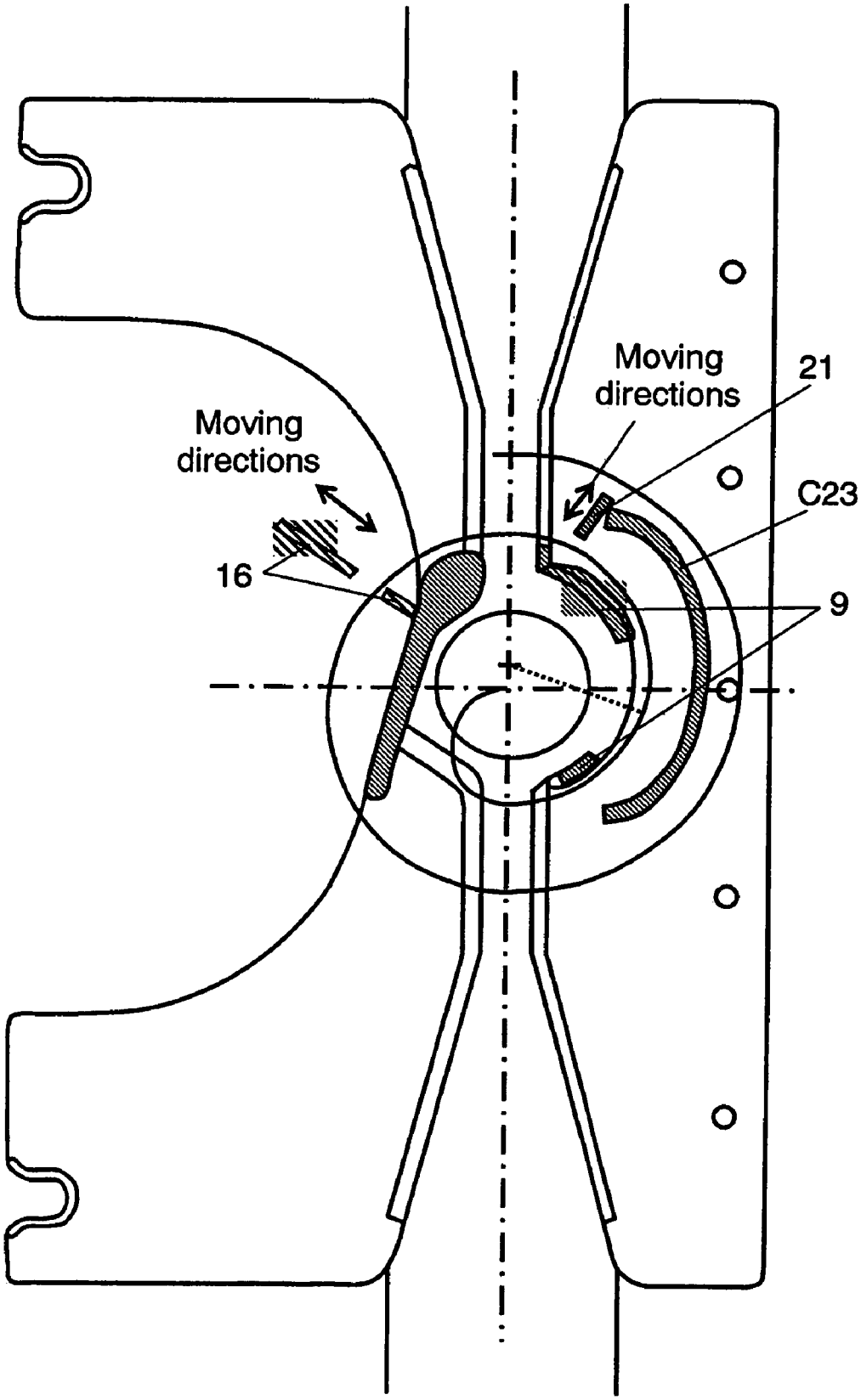
FIG. 10 shows yet another phase slit of the present invention.

The present invention is not limited to the phase slit of the embodiment. FIGS. 9 and 10 show other examples of the phase slit of the present invention. The phase slit of FIG. 9 has no electrode disposed in a radially-outward direction. It will be understood that the present invention can be realized—even with the structure having no electrode in a radially-outward direction—as long as an RF acceleration voltage different in phase from the voltage previously applied at the gap by properly selecting acceleration conditions and/or ion seeds. In this case, the electrode with an opening should preferably be a movable structure. The beam blocking section may be, just like beam blocking section 21 of FIG. 9, disposed in the dee electrode on which the electrode having an opening. FIG. 10 shows yet another phase slit of the present invention. In the structure, the electrode disposed in a radially-outward direction has a thin form. Making improvements to a driving device or a pedestal (on which electrode A15 is mounted) allows electrode A15 to have wider movable range. In this case, as shown in FIG. 10, electrode C23 should preferably be formed thin so as not to intrude on the second-turn of the orbit of a particle.

[Applicability to the Production of Positron Drugs]

As described above, the present invention provides an improved cyclotron having a beam phase selector capable of properly selecting the pulse width of a beam and improving beam permeability; accordingly, offering larger beam current. Such an improved cyclotron can provide ion beams with high quality and high intensity. The beam accelerated in the cyclotron is effectively used for improving a target product or incorporating additional functions into a product. In the field of medicine, for example, positron drugs—which are employed for cancer check using a positron CT—will be prepared with high productivity. The effective production increases the preparation amount of the positron drugs per day, contributing to a cost-reduced medical examination.

INDUSTRIAL APPLICABILITY

The present invention provides a cyclotron having a beam phase selector capable of obtaining a consistent phase width and offering improved beam permeability for increasing beam current. The applicability to the industrial fields is highly expected.

What is claimed is:

1. A cyclotron with a beam phase selector comprising:

an acceleration voltage applying section for applying an RF acceleration voltage to a particle passing a gap between dee electrodes, and further applying to said particle an RF acceleration voltage having a phase different from the RF acceleration voltage previously applied to the particle at the gap between the dee electrodes; and a beam blocking section for blocking undesired particles, wherein, at least any one of the acceleration voltage applying section and the beam blocking section has a movable structure.

2. The cyclotron with the beam phase selector of claim 1, wherein the acceleration voltage applying section at least contains an electrode with an opening in a direction of a core of the cyclotron.

3. The cyclotron with the beam phase selector of claim 2, wherein the acceleration voltage applying section at least contains an electrode disposed at a radially-outward position of the cyclotron so as to confront to the electrode with the opening in a direction of the core of the cyclotron.

4. The cyclotron with the beam phase selector of claim 3, wherein the beam blocking section is an electrode disposed at a radially-outward position of the cyclotron.

5. The cyclotron with the beam phase selector of claim 2, wherein the electrode with the opening in a direction of the core of the cyclotron is disposed in the dee electrode.

6. The cyclotron with the beam phase selector of claim 1, wherein the beam blocking section blocks the undesired particles on a first turn of an orbit.

7. The cyclotron with the beam phase selector of claim 1, wherein the beam blocking section is disposed in at least any one of a radially-inward and a radially-outward positions of the cyclotron with respect to a central orbit of the beam.

8. The cyclotron with the beam phase selector of claim 1, wherein the acceleration voltage applying section doubles as the beam blocking section.

9. The cyclotron with the beam phase selector of claim 1, wherein operations on phase-width control can be performed outside the cyclotron, with vacuum condition in an evacuated box maintained.

10. The cyclotron with the beam phase selector of claim 1, wherein said cyclotron produces positron drugs.

* * * * *